US006601681B1

(12) United States Patent
Gerner et al.

(10) Patent No.: US 6,601,681 B1
(45) Date of Patent: Aug. 5, 2003

(54) DRIVE MECHANISM FOR A ROTATING COMPONENT OF A PRINTING MACHINE

(75) Inventors: Erich Max Karl Gerner, Bütthard (DE); Christoph Alfons Schmitt, Dittelbrunn (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/581,527

(22) PCT Filed: Jan. 29, 1999

(86) PCT No.: PCT/DE99/00230

§ 371 (c)(1),
(2), (4) Date: Jul. 7, 2000

(87) PCT Pub. No.: WO99/38690

PCT Pub. Date: Aug. 5, 1999

(30) Foreign Application Priority Data

Jan. 30, 1998 (DE) ..... 198 63 557

(51) Int. Cl.[7] ..... B41F 13/008
(52) U.S. Cl. ..... 192/34; 192/69.91; 192/109 R
(58) Field of Search ..... 192/34, 109 R, 192/69.91, 69.9

(56) References Cited

U.S. PATENT DOCUMENTS

| | | | | |
|---|---|---|---|---|
| 2,845,781 A | * | 8/1958 | O'brien | 464/156 |
| 3,406,600 A | * | 10/1968 | Minick | 83/13 |
| 4,194,279 A | * | 3/1980 | Haslhofer | 29/281.5 |
| 4,607,734 A | * | 8/1986 | Watashi et al. | 192/108 |
| 5,044,481 A | * | 9/1991 | Yoshida et al. | 192/69.91 |
| 5,069,394 A | * | 12/1991 | Pantilla et al. | 192/69.91 X |
| 5,090,535 A | * | 2/1992 | Schiel et al. | 192/69.91 |
| 5,701,818 A | | 12/1997 | Mohrmann | |

FOREIGN PATENT DOCUMENTS

| | | |
|---|---|---|
| DE | 24 36 199 | 2/1975 |
| DE | 34 32 572 | 3/1985 |
| DE | 44 30 693 | 3/1996 |
| DE | 195 39 984 | 4/1997 |
| EP | 0 768 174 | 4/1997 |

* cited by examiner

*Primary Examiner*—Saul Rodriguez
(74) *Attorney, Agent, or Firm*—Jones, Tullar & Cooper, PC

(57) ABSTRACT

A drive mechanism for a rotating component of a printing machine uses a drive motor. The drive motor is connected to the rotating component by a coupling and is supported for axial displacement between coupled and uncoupled positions.

6 Claims, 3 Drawing Sheets

DRIVE MECHANISM FOR A ROTATING COMPONENT OF A PRINTING MACHINE

FIELD OF THE INVENTION

The invention relates to a drive mechanism for a rotating component of a printing press.

BACKGROUND OF THE INVENTION

DE 44 30 693 A1 discloses print units of a rotary offset printing press in which at least one cylinder is separately driven.

DE 34 32 572 A1 shows a directly driven screen roller of a rotary printing press. A journal of this screen roller is connected with a rotor of an electric motor by means of a coupling.

DE 195 39 984 A1 discloses a drive mechanism for a print unit of a rotary printing press. Here, a motor is flanged to a lateral frame and is connected with a driveshaft by means of a releasable coupling.

SUMMARY OF THE INVENTION

The object of the invention is based on producing a drive mechanism for a rotating component of a printing press.

In accordance with the invention, this object is attained by a drive mechanism for rotating component of a printing press which, in the coupled-in state, is connected with a motor by means of a coupling. In an uncoupled operating state, the motor is arranged in a second position, in which the motor is arranged offset in the axial direction in relation to a first position.

In connection with the drive mechanism in accordance with the invention for a rotating component, for example cylinders or rollers of a printing press, it is possible in an advantageous manner for the associated drive motor to remain in the printing press even in the uncoupled state. The drive motor arranged on the lateral frame even in the uncoupled state is, so that uncoupling is possible with a small amount of force.

This arrangement is particularly advantageous in connection with rollers which can be removed from the printing press.

BRIEF DESCRIPTION OF THE DRAWINGS

A exemplary embodiment of the invention is represented in the drawings and will be described in greater detail in what follows.

Shown are in.

DESCRIPTION OF THE PREFERRED EMBODIMENTS

Figure 1:
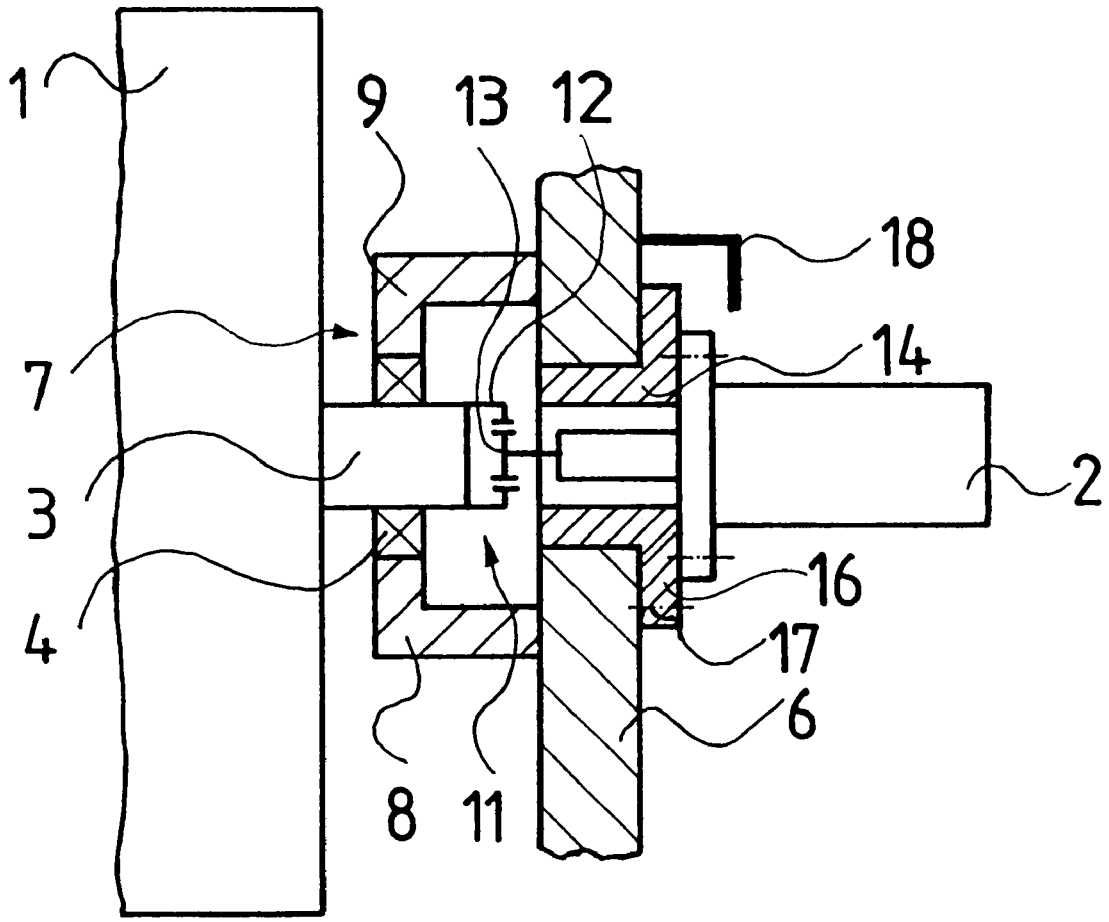
FIG. 1, a schematic representation of a drive mechanism of a screen roller in the coupled-in state.
Figure 2:
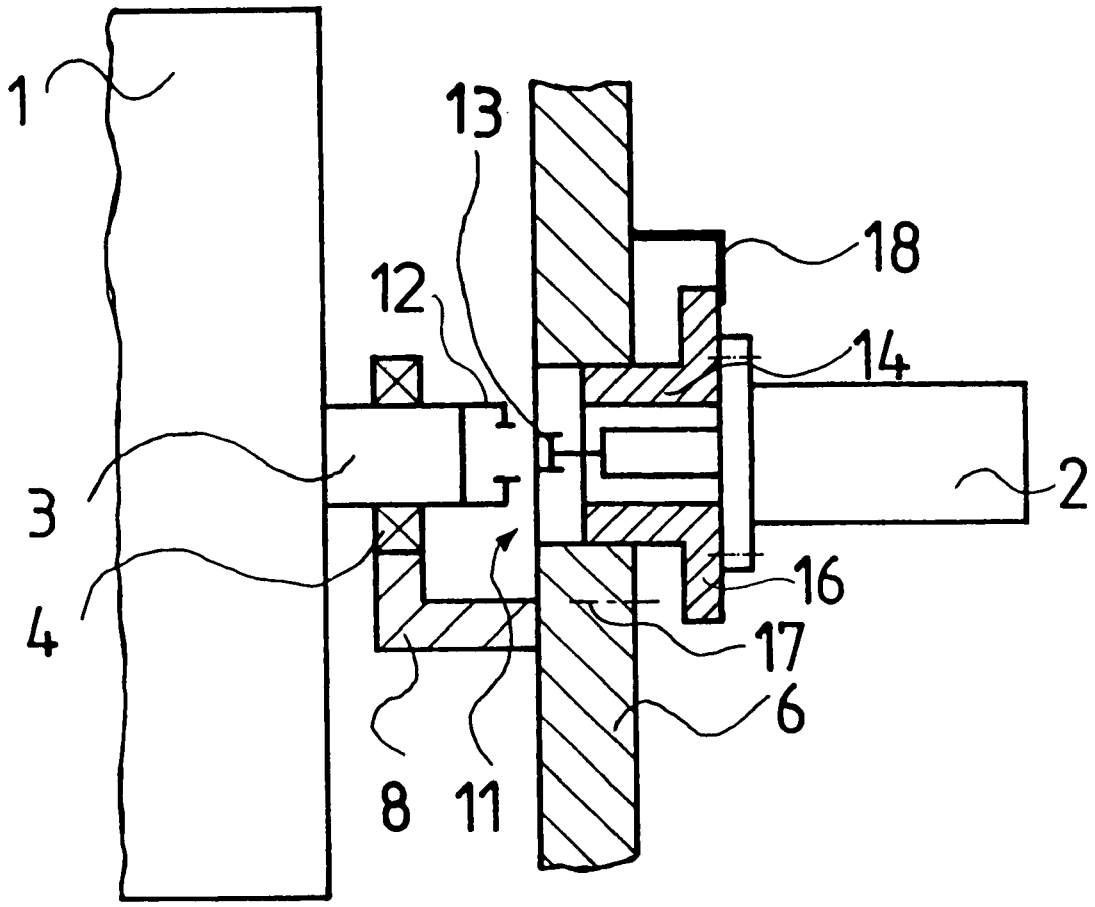
FIG. 2, a schematic representation of the drive mechanism of a screen roller in the uncoupled state and FIG. 3 a schematic representation of a second preferred embodiment of a drive mechanism of a screen roller in the coupled-in state.

A rotating component, for example a roller 1 or a cylinder of a rotary printing press, is directly driven by means of a motor 2, for example a position-controlled electric motor. In the present example, the rotating component 1 can be removed from the rotary printing press and is designed as a screen roller 1.

Only one end of the screen roller 1 is represented in the drawings.

The screen roller 1 has two journals 3, each of which is provided with a bearing 4 and is rotatably seated between side or lateral frames 6 of the printing press. In the present example, the bearing 4 is received in a two-part bearing receiver 7. A first bearing shell 8 of this bearing receiver 7 is arranged on the inside of the lateral frame 6 adjustable in respect to it and remains on the lateral frame 6, even when the screen roller 1 is removed. A second bearing shell 9 is releasably connected with this first bearing shell 8.

The journal 3 of the screen roller 1 is connected with a rotor of the motor 2 by means of a coupling 11. To this end, the front of the journal 3 of the screen roller 1 is provided with a first coupling half, which is designed as a hollow gear wheel 12 with teeth on the inside. An associated second coupling half is arranged on the front of a rotor of the motor 2 and is designed as a gear wheel 13 with teeth on the outside and matched to the hollow gear wheel 12.

A collar bushing 14 is flanged to a flange on the front of the motor 2. This collar bushing 14 is rotatably seated in a bore of the lateral frame 6 and is displaceable in the axial direction of the screen roller 1. A collar 16 of this collar bushing 14 is secured, fixed axially and against relative rotation by means of a securing element 17, for example a threaded screw 17, on an outside of the lateral frame 6. The collar 16 of the collar bushing 14 is provided with a keyhole-like bore for this purpose. A stop 18, fixed in place, is arranged on the outside of the lateral frame 6 for limiting the axial lift of the collar bushing 14 in respect to the lateral frame 6.

Figure 3:
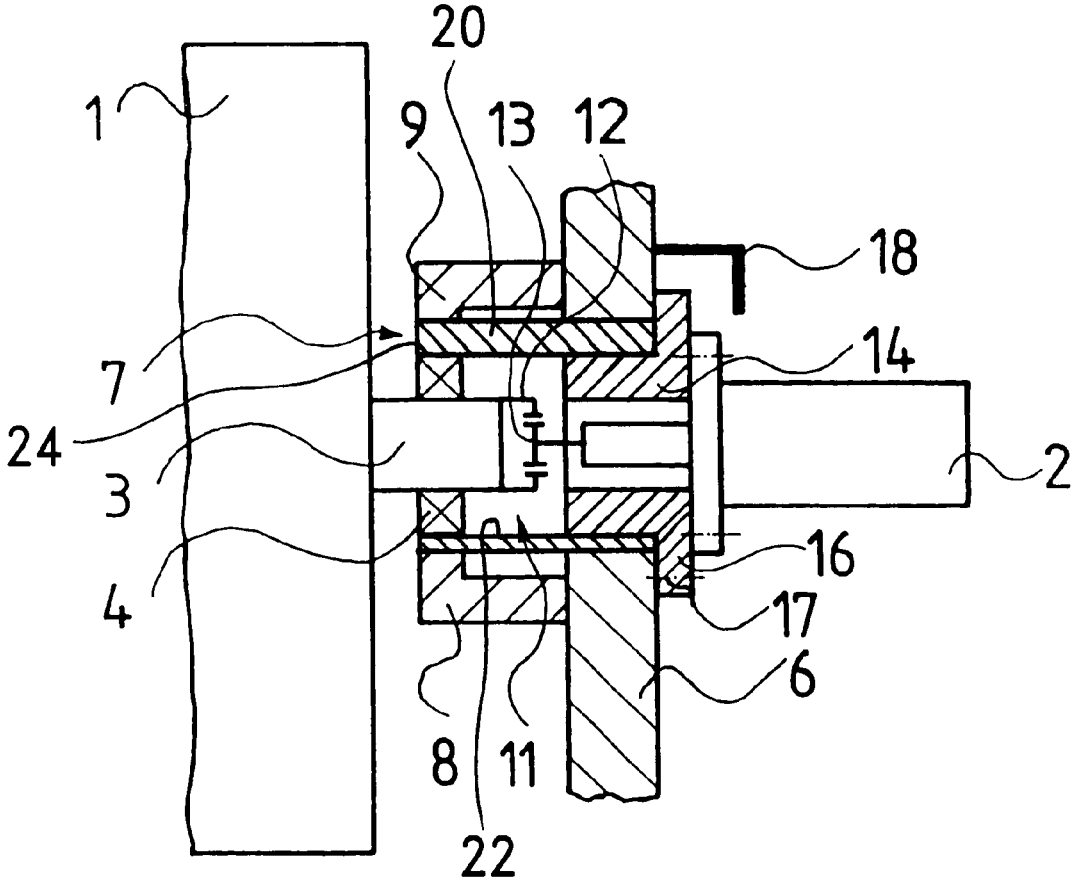

In a second exemplary embodiment, represented in FIG. 3, a position of the screen roller 1 and a position of the motor 2 are changeable. An axis of rotation of the screen roller 1 and an axis of rotation of the motor 2 are arranged aligned with each other. A pivotable eccentric bushing 20 is provided in the lateral frame 6 for the mutual position change of the screen roller 1 and the motor 2, in whose bore 22 the collar bushing 14 is arranged in the manner already described and on whose end 24, which faces in the direction toward the screen roller 1, the bearing receiver 7 is fastened.

The motor 2 can also be also be directly fastened on an eccentric bushing, and this eccentric bushing can be axially displaceable.

Functioning of the drive mechanism in accordance with the invention is as follows:

In a first operating state, the screen roller is coupled to a motor 2. In this case the collar 16 of the collar bushing 14 rests against the outside of the lateral frame 6 and is secured against rotation and is axially not displaceable in respect to the lateral frame 6 by means of the threaded screw 17. The screen roller 1 is rotatably arranged in the bearing receiver 7. In this first operating state the gear wheel 13 of the motor 2 meshes with the hollow gear wheel 12 of the screen roller 1.

In a second operating state the screen roller 1 is uncoupled from the motor 2. To accomplish this, the threaded screw 17 for securing the collar bushing 14 is loosened and the collar bushing 14 is pivoted, so that the greater portion of the keyhole-like bore lies in the area of the threaded screw 17. Subsequently the collar bushing 14 and the motor 2 are together moved away from the screen roller 1 in the axial direction. The axial lift is at least large enough that the gear wheel 13 and the hollow gear wheel 12 of the coupling 11 are no longer in engagement. To limit the lift, the collar 16 of the collar bushing 14 rests against the stop on the lateral frame 6. In this state, too, is the motor 2 coupled to the lateral frame 6, in the present exemplary embodiment the motor 2 is interlocking connected with the lateral frame 6 in both operating states.

A helix-shaped groove and a bolt meshing with it can be provided on the lateral frame 6 and the collar bushing 14 for producing the axial lift.

What is claimed is:

1. A drive mechanism for a printing press comprising:

a permanently fixed lateral frame of the printing press;

a rotatable component of the printing press, said rotatable component having an axis of rotation and being supported in said permanently fixed lateral frame for rotation about said axis of rotation and against movement in a direction of said axis of rotation;

a drive motor adapted to rotate said rotatable component about said axis of rotation;

a coupling between said drive motor and said rotatable component, said coupling including a first coupling portion connected to said rotatable component and a second coupling portion connected to said drive motor; and means supporting said drive motor on said permanently fixed lateral frame for movement of said drive motor with respect to said rotatable component along said axis of rotation of said rotatable component between a first, coupled-in portion of said motor in which said first and said second coupling components are engaged and a second, uncoupled portion of said motor in which said first and said second coupling components are disengaged.

2. The drive mechanism of claim 1 further including a stop on said permanently fixed lateral frame of the printing press, said drive motor being in engagement with said stop in said second, uncoupled portion of said drive motor.

3. The drive mechanism of claim 1 wherein said rotatable component is a roller.

4. The drive mechanism of claim 1 wherein said rotatable component is a cylinder.

5. The drive mechanism of claim 1 further including an eccentric bushing in said permanently fixed lateral frame, said eccentric bushing supporting said rotatable component and said drive motor, said eccentric bushing being rotatable in said permanently fixed lateral frame to shift said rotatable component and said drive motor to change a location of said axis of rotation of said rotatable component and an axis of rotation of said drive motor in said permanently fixed lateral frame.

6. The drive mechanism of claim 1 further including means supporting said rotatable component for removal from said permanently fixed lateral frame of the printing press in a direction perpendicular to said axis of rotation when said drive motor is in said second, uncoupled position.

* * * * *